US009533487B2

(12) United States Patent
Knauer et al.

(10) Patent No.: US 9,533,487 B2
(45) Date of Patent: Jan. 3, 2017

(54) DEVICE AND METHOD FOR FOLDING A PRINT SUBSTRATE WEB

(71) Applicant: manroland web systems GmbH, Augsburg (DE)

(72) Inventors: Peter Knauer, Muenster/Lech (DE); Hubert Schalk, Thierhaupten (DE)

(73) Assignee: manroland web systems GmbH, Augsburg (DE)

( * ) Notice: Subject to any disclaimer, the term of this patent is extended or adjusted under 35 U.S.C. 154(b) by 0 days.

(21) Appl. No.: 14/467,882

(22) Filed: Aug. 25, 2014

(65) Prior Publication Data

US 2014/0364293 A1 Dec. 11, 2014

Related U.S. Application Data

(63) Continuation of application No. 13/460,373, filed on Apr. 30, 2012, now Pat. No. 8,833,750.

(30) Foreign Application Priority Data

Oct. 20, 2011 (DE) ..... 10 2011 116 466

(51) Int. Cl.

| | |
|---|---|
| ***B41F 13/56*** | (2006.01) |
| ***B41F 13/58*** | (2006.01) |
| ***B41F 13/60*** | (2006.01) |
| ***B41F 13/70*** | (2006.01) |
| ***B65H 29/60*** | (2006.01) |
| ***B31F 1/00*** | (2006.01) |
| ***B41F 13/62*** | (2006.01) |
| ***B42B 2/02*** | (2006.01) |
| ***B42C 19/06*** | (2006.01) |

(52) U.S. Cl.

CPC ..... *B41F 13/56* (2013.01); *B31F 1/0009* (2013.01); *B41F 13/58* (2013.01); *B41F 13/60* (2013.01);

(Continued)

(58) Field of Classification Search

CPC ..... B41F 13/56; B41F 13/60; B41F 13/70; B65H 29/60; B65H 2301/44552; B65H 2801/31

(Continued)

(56) References Cited

U.S. PATENT DOCUMENTS 4,373,713 A * 2/1983 Loebach ..... 271/303
4,534,552 A 8/1985 Rahe (Continued)

FOREIGN PATENT DOCUMENTS

| | | | |
|---|---|---|---|
| DE | 10 2006 014 218 | A1 | 10/2007 |
| FR | 2 820 682 | A1 | 8/2002 |
| WO | WO 2010/127148 | A1 | 11/2010 |

OTHER PUBLICATIONS

Chinese Office Action issued in Chinese counterpart application No. 201210517519.8 dated Oct. 19, 2015, with partial English translation (Fifteen (15) pages).

(Continued)

*Primary Examiner* — Leslie A Nicholson, III
(74) *Attorney, Agent, or Firm* — Crowell & Moring LLP

(57) ABSTRACT

A device and a method for folding a print substrate web is disclosed. The device has devices for quarter folding and for cross-cutting the print substrate web for severing individual products as well as devices for cross folding. As viewed in the transport direction of the products, an arrangement for dividing the product stream is provided after a second quarter folding device, the arrangement conveying the successive products to a first and a second conveyor belt in an alternating manner.

9 Claims, 4 Drawing Sheets

(52) U.S. Cl.
CPC ..... *B41F 13/62* (2013.01); *B41F 13/70* (2013.01); *B42B 2/02* (2013.01); *B42C 19/06* (2013.01); *B65H 29/60* (2013.01); *B65H 2301/44552* (2013.01); *B65H 2701/1932* (2013.01); *B65H 2801/31* (2013.01)

(58) Field of Classification Search
USPC .... 270/4, 5.01, 5.02, 5.03, 6–18, 20.1, 21.1, 270/52.07, 52.09, 52.11
See application file for complete search history.

(56) References Cited

U.S. PATENT DOCUMENTS

| | | | | |
|---|---|---|---|---|
| 4,564,470 | A * | 1/1986 | Schmitt | 270/21.1 |
| 4,811,641 | A | 3/1989 | Mueller | |
| 6,010,122 | A | 1/2000 | Weber | |
| 6,394,445 | B1 * | 5/2002 | d'Agrella et al. | 271/182 |
| 6,886,823 | B2 * | 5/2005 | Herbert | 270/20.1 |
| 6,941,862 | B2 * | 9/2005 | Weiler | 101/227 |
| 7,850,588 | B2 * | 12/2010 | St. Ours et al. | 493/423 |
| 7,988,608 | B2 * | 8/2011 | Schnell et al. | 493/416 |
| 8,001,892 | B2 * | 8/2011 | Eckert et al. | 101/228 |
| 2006/0231996 | A1 * | 10/2006 | Held et al. | 270/5.02 |
| 2009/0290924 | A1 * | 11/2009 | Gagnon et al. | 400/234 |
| 2009/0295058 | A1 * | 12/2009 | Schnell et al. | 270/41 |
| 2010/0288145 | A1 * | 11/2010 | St. Ours et al. | 101/227 |

OTHER PUBLICATIONS

French Search Report issued in French counterpart application No. 1259930 dated Jul. 23, 2015 (Three (3) pages).

* cited by examiner

DEVICE AND METHOD FOR FOLDING A PRINT SUBSTRATE WEB

This application is a continuation of prior U.S. application Ser. No. 13/460,373, filed Apr. 30, 2012, which claims the priority of German Patent Document No. DE 10 2011 116 466.2, filed Oct. 20, 2011, the disclosures of which are expressly incorporated by reference herein.

BACKGROUND AND SUMMARY OF THE INVENTION

The invention relates to a device and a method for folding a print substrate web.

It is generally known when producing printed products to print individual pages on a print substrate web using a web-fed rotary printing press and then to put them into the desired page sequence by quarter folding and cross folding as well as to sever the individual products from the print substrate web by cross cutting the print substrate web.

In the process, after being printed in printing units, the print substrate web is cut into partial webs by slitting, which are put on top of each other in a generally known manner and quarter folded using formers. Afterwards, the individual printed products are severed from the print substrate web by cross cutting and cross folded once or multiple times in a folder, i.e., offset at a right angle to the aforementioned quarter fold. The printed products may be transported via tape guides in a known manner to a further folding device, which executes a further, i.e., a second, quarter fold. Then the printed products may be delivered via a fan wheel onto a delivery conveyor in a shingle-like manner.

Furthermore, web-fed rotary printing presses having so-called double circumference plate cylinders are generally known, whose circumference provides double the printing length as compared to conventional impression cylinders. These types of double circumference plate cylinders are able to produce two identical printed products with one revolution of the impression cylinder with so-called double production. However, it is also possible on such a double circumference plate cylinder to arrange different printed images, i.e., printed products. Then one Product A and one Product B with a different content than Product A are printed with every revolution of the impression cylinder.

The object of the invention is creating a novel device for folding a print substrate web.

A folding device according to the invention allows successive different printed products of a web-fed rotary printing press having double circumference plate cylinders to be divided especially advantageously into two separate product streams. Separating the different printed products (A and B products) is possible in the case of a folding device according to the invention with only one second quarter fold device. In other words, in the case of a folding device according to the invention, the investment in a second apparatus for executing a second quarter fold ("third fold") is saved.

Additional features and advantages are disclosed in the dependent claims in conjunction with the description.

The invention will be explained in greater detail in the following based on the associated schematic drawings as follows.

DETAILED DESCRIPTION OF THE DRAWINGS

Figure 1:
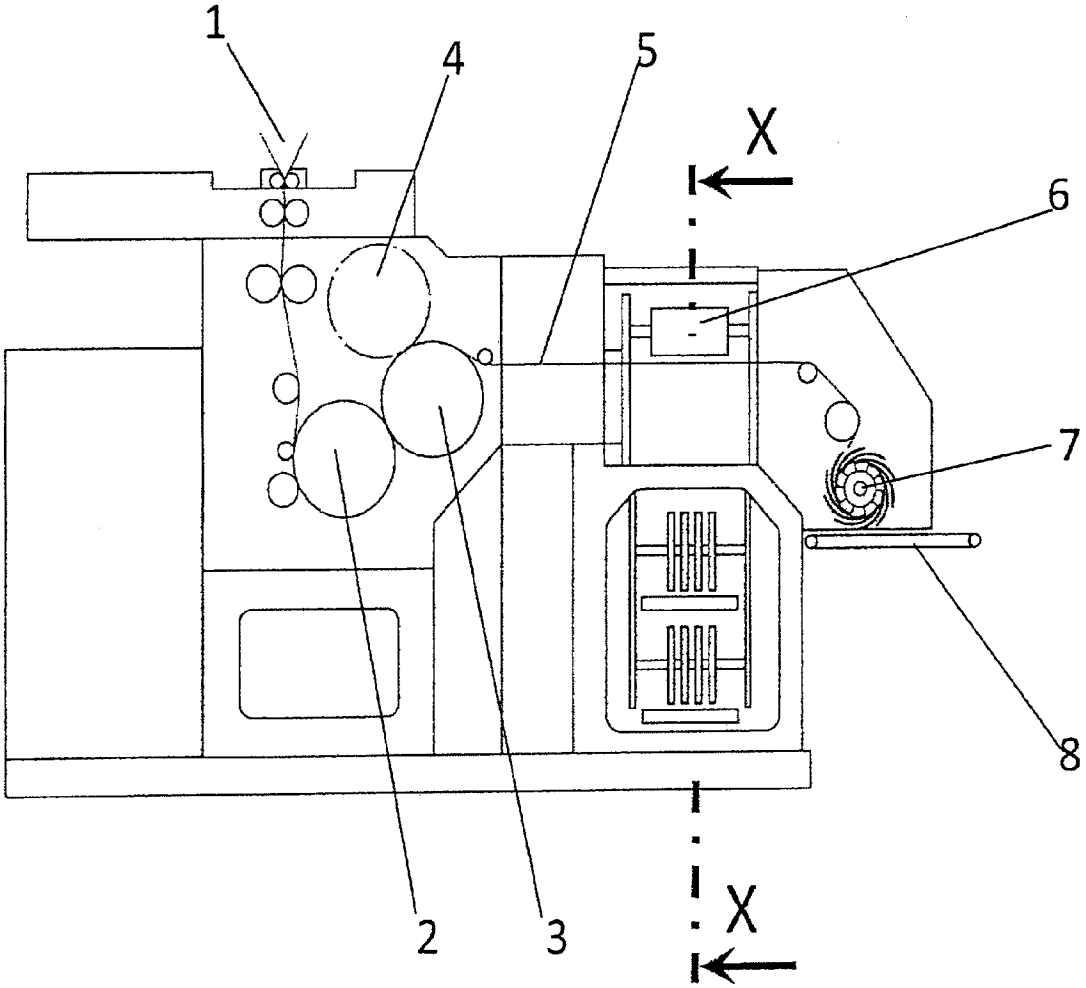
FIG. 1 shows a folding device according to the invention viewed from the side.
Figure 1A:
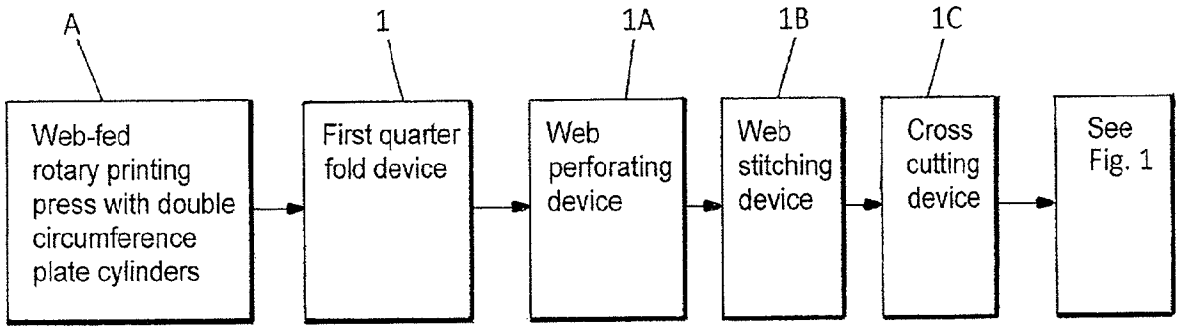
FIG. 1A schematically shows a web-fed rotary printing press with double circumference plate cylinders in combination with components of a folding device according to the invention.
Figure 2:
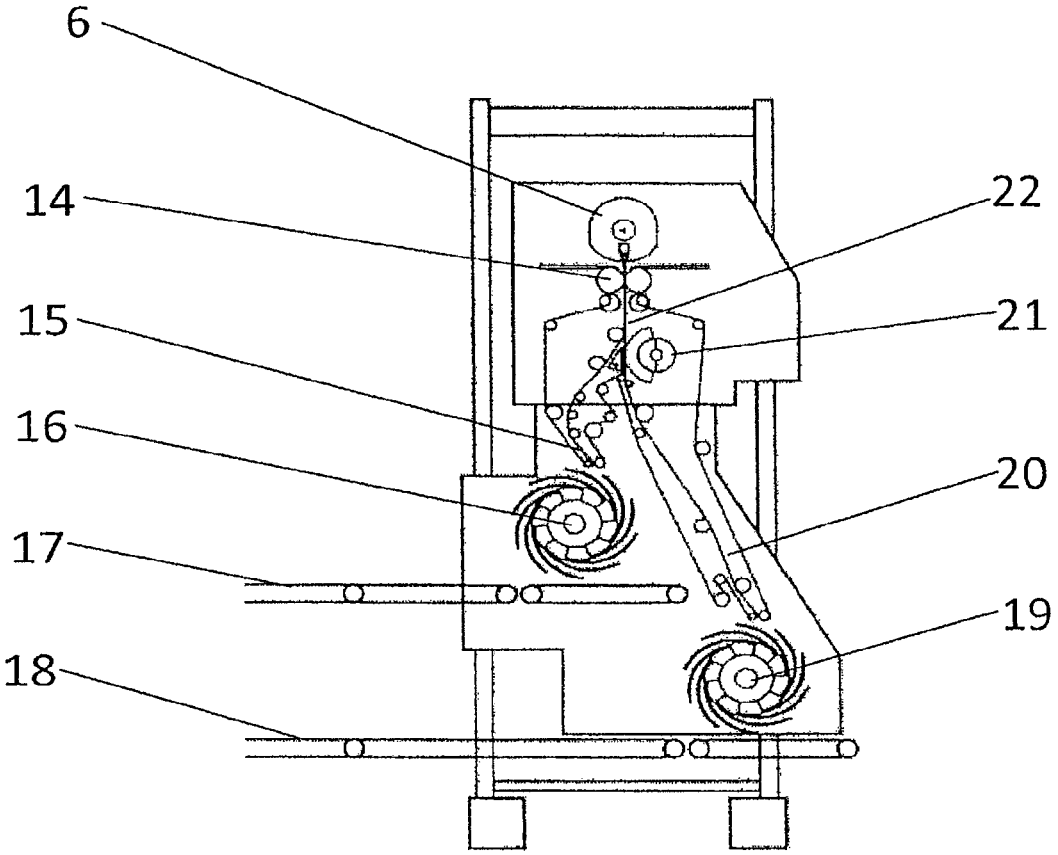
FIG. 2 depicts view X-X from FIG. 1.

FIGS. 1A and 1 depict a folding device according to the invention, which preferably interacts with a web-fed rotary printing press A. This web-fed rotary printing press is preferably equipped with double circumference plate cylinders, whose circumference has double the printing length as compared to conventional impression cylinders and on whose circumference two successive different printed products are accommodated.

The double circumference plate cylinders print double the number of printed pages on the print substrate web with each revolution of the cylinder and are therefore able to produce twice the quantity of printed products during so-called double production or produce successively different printed products (A-B products) during so-called A-B production.

The print substrate web printed in this manner is then preferably conveyed via a so-called folding superstructure, in which the print substrate web may be cut longitudinally and the partial webs that are thereby produced may be turned on top of one another, to a former 1, which makes a first quarter fold parallel to the transport direction on the print substrate web, a partial web or, if applicable, several stacked partial webs.

Afterwards, individual products are severed from the print substrate web by cross cutting using a cross cutting device 1C, and the products are then picked up by a first folding cylinder 2 on its circumference.

Prior to cross cutting the quarter folded web(s), arrangements may be made in the web progression for longitudinal and/or cross perforating by a web perforating device 1A and/or for applying stitching by a web stitching device 1B.

In the interaction of the first folding cylinder 2 with a further folding cylinder 3, the printed products are cross folded, i.e., receive an additional fold that is offset at a right angle from the aforementioned quarter fold.

Due to the interaction of the additional folding cylinder 3 with a folding cylinder 4, it is possible to make a further cross fold on the printed products. If this is not desired, the folding cylinder 4 may be deactivated.

After the cross folding, the printed products are preferably transported by a conveyor belt 5 to a further quarter fold device 6. If no further quarter fold is desired, the quarter fold device may be deactivated and the conveyor belt 5 could convey the printed products to a fan wheel 7, which delivers the printed products onto a delivery conveyor 8 in a shingle-like manner.

If a further fold, i.e., a second quarter fold, is desired, the quarter fold device 6 presses the printed products downward preferably with a folding knife moving up and down in a cyclical manner, where the printed products are again folded between two rotating folding rollers 14. This fold runs parallel to the first quarter fold and is therefore called the second quarter fold.

After the second quarter folding, the printed products are conveyed by a conveyor belt 22 to a splitter 21, which diverts every second printed product—preferably using a cam—to a further conveyor belt 15, whereby these printed products are conveyed to a first fan wheel 16 and are delivered by the fan wheel onto an optionally multi-part delivery conveyor 17 preferably in a shingle-like manner.

The printed products that are not diverted by the cam of the splitter 21 are conveyed by a further conveyor belt 20 to a fan wheel 19 and delivered by the fan wheel onto an optionally multi-part delivery conveyor 18 preferably in a shingle-like manner.

The conveyor belts 22 and 20 are structurally designed preferably as a common conveyor belt, which conveys the products to the lower fan wheel 19, wherein to divide the product stream the splitter 21 diverts every second printed product from the area of this conveyor belt and conveys it to the other conveyor belt 15, which transports these products to the fan wheel 16.

In the diverting of the printed products by the rotating cam, the products are pushed to the side, wherein the circumferential speed of the cam and the transport speed of the product/printed copy almost match so that a relative speed is hardly present. As a result, ink offsetting is prevented in an advantageous manner and the splitter experiences almost no wear.

Because of dividing the product stream as viewed in the transport direction of the products, after the second quarter fold device 6, it is possible in the case of the A-B production mentioned at the outset, to separate the different printed products A and B from one another in a simple manner and deliver them separately.

Depending upon how the splitter 21 is controlled, the A products may be delivered on the upper delivery 17 and the B products on the lower delivery 18 or vice versa.

It is also possible with the folding device according to the invention to divide a collected product, i.e., a product in which all pages printed with one revolution of the impression cylinder are assembled into a common product, into two product streams and to deliver them separately on the delivery conveyors 17, 18. This also applies of course to so-called double production, in which two A products are produced with one revolution of the impression cylinder.

Figure 3:
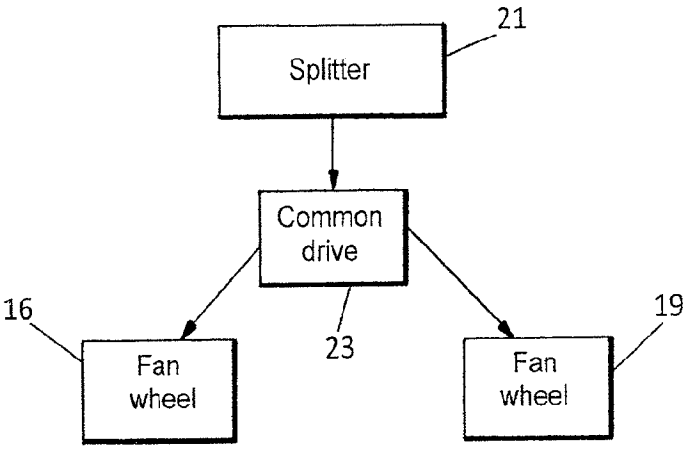
FIG. 3 schematically shows the common drive of the folding device of the present invention.

As shown schematically in FIG. 3, one common drive 23 is preferably provided for the splitter 21 and the fan wheels 16, 19, which drives these independently of the other devices in the folding device.

In the case that the product stream is not supposed to be divided, the speed of the splitter 21 and of the fan wheels 16, 19 may be doubled in a simple manner so that the cam of the splitter 21 respectively engages in a gap between two successive products and conveys all products into the fan wheel 19 via the conveyor belt 20.

The delivery conveyors 17, 18 are preferably disposed in such a way that they transport the products respectively in the same direction.

The delivery conveyors 17, 18 are preferably disposed at different heights or levels.

Instead of a splitter that works with a cam, the product stream may also be divided by devices that operate in a different manner.

LIST OF REFERENCE NUMBERS

A Web-fed rotary printing press with double circumference plate cylinders
1A Web perforating device
1B Web stitching device
1C Cross cutting device
1 Former
2 Folding cylinder
3 Folding cylinder
4 Folding cylinder
5 Conveyor belt
6 Quarter fold device
7 Fan wheel
8 Delivery conveyor
14 Folding rollers
15 Conveyor belt
16 Fan wheel
17 Delivery conveyor
18 Delivery conveyor
19 Fan wheel
20 Conveyor belt
21 Splitter
22 Conveyor belt
23 Common drive The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A device for printing and folding a print substrate web, comprising:

a web-fed rotary printing press having double circumference plate cylinders, wherein the print substrate web is printable by the web-fed rotary printing press;

a first quarter fold device;

a cross cutting device, wherein the cross cutting device is disposed downstream in a transport direction from the first quarter fold device;

a cross fold device, wherein the cross fold device is disposed downstream in the transport direction from the cross cutting device;

only one second quarter fold device, wherein the only one second quarter fold device is disposed downstream in the transport direction from the cross fold device;

a splitter, wherein the splitter is disposed downstream in the transport direction from the only one second quarter fold device; and a first conveyor and a second conveyor;

wherein successive printed products severed from the print substrate web by the cross cutting device are conveyable by the splitter to the first conveyor and the second conveyor in an alternating manner;

wherein the first conveyor and the second conveyor convey respective printed products to a first fan wheel and a second fan wheel, respectively;

wherein a common drive drives the splitter and the first fan wheel and the second fan wheel and wherein the common drive does not drive other devices.

2. The device according to claim 1, wherein the first fan wheel and the second fan wheel deliver respective printed products to a first delivery conveyor and a second delivery conveyor, respectively.

3. The device according to claim 2, wherein the first delivery conveyor and the second delivery conveyor transport the printed products in a same direction.

4. The device according to claim 2, wherein the first delivery conveyor and the second delivery conveyor are disposed at respective different heights.

5. The device according to claim 1, further comprising:

a web perforating device; and a web stitching device;

wherein the web perforating device and the web stitching device are disposed downstream in the transport direction from the first quarter fold device and upstream in the transport direction from the cross cutting device.

6. The device according to claim 1, further comprising a second cross fold device, wherein the second cross fold device is disposed downstream in the transport direction from the cross fold device and upstream in the transport direction from the second quarter fold device.

7. A method for printing and folding a print substrate web, comprising the steps of:

printing the print substrate web by a web-fed rotary printing press having double circumference plate cylinders;

folding the print substrate web with a first quarter fold parallel to a transport direction of the print substrate web by a first quarter fold device;

severing the print substrate web to form individual print products by cross-cutting the print substrate web;

cross folding the individual print products;

folding the individual print products with a second quarter fold by only one second quarter fold device; and conveying successive individual print products to a first conveyor and a second conveyor in an alternating manner by a splitter following the step of folding the individual print products with the second quarter fold;

wherein the first conveyor and the second conveyor convey the respective successive individual print products to a first fan wheel and a second fan wheel, respectively;

wherein a common drive drives the splitter and the first fan wheel and the second fan wheel and wherein the common drive does not drive other devices.

8. The device according to claim 1, wherein a cam of the splitter diverts a first printed product to the first conveyor and wherein the cam does not divert a second printed product such that the splitter conveys the second printed product to the second conveyor.

9. The method according to claim 7, wherein a cam of the splitter diverts a first print product to the first conveyor and wherein the cam does not divert a second print product such that the splitter conveys the second print product to the second conveyor.

* * * * *